US009868192B2

(12) United States Patent
Arnold

(10) Patent No.: US 9,868,192 B2
(45) Date of Patent: Jan. 16, 2018

(54) LIGHT FIXTURE AND TOOL FOR INSTALLING LIGHT FIXTURE

(71) Applicant: Bruce Young Arnold, Cambridge, MA (US)

(72) Inventor: Bruce Young Arnold, Cambridge, MA (US)

( * ) Notice: Subject to any disclaimer, the term of this patent is extended or adjusted under 35 U.S.C. 154(b) by 16 days.

(21) Appl. No.: 14/745,442

(22) Filed: Jun. 21, 2015

(65) Prior Publication Data

US 2016/0368123 A1 Dec. 22, 2016

(51) Int. Cl.

| | |
|---|---|
| ***B25B 15/00*** | (2006.01) |
| ***F21S 8/00*** | (2006.01) |
| ***F21V 21/10*** | (2006.01) |
| ***F21V 23/00*** | (2015.01) |
| ***F21S 8/04*** | (2006.01) |
| ***F21V 3/00*** | (2015.01) |
| ***F21V 21/03*** | (2006.01) |

(52) U.S. Cl.
CPC ..... *B25B 15/002* (2013.01); *F21S 8/036* (2013.01); *F21S 8/04* (2013.01); *F21V 3/00* (2013.01); *F21V 21/03* (2013.01); *F21V 21/10* (2013.01); *F21V 23/008* (2013.01)

(58) Field of Classification Search
CPC ..... F21S 8/043; F21S 8/04
See application file for complete search history.

(56) References Cited

U.S. PATENT DOCUMENTS

| | | | | |
|---|---|---|---|---|
| 3,409,224 | A * | 11/1968 | Harp | A47G 21/186 138/121 |
| 5,074,173 | A * | 12/1991 | Cearley | B25B 13/483 81/125 |
| 5,317,493 | A | 5/1994 | Muller | |
| 5,434,356 | A | 7/1995 | Zekowski | |
| 5,718,681 | A * | 2/1998 | Manning | A61J 7/0038 239/33 |
| 6,325,654 | B1 * | 12/2001 | Kerr, Jr. | F04D 25/088 439/313 |
| 6,799,982 | B2 * | 10/2004 | Kerr, Jr. | F21V 21/02 439/140 |
| 8,057,077 | B2 | 11/2011 | Gagne | |
| 2004/0218396 | A1 | 11/2004 | Garber | |
| 2004/0246708 | A1 | 12/2004 | Wu | |
| 2004/0246729 | A1 | 12/2004 | Wu | |
| 2006/0285357 | A1 | 12/2006 | Shyu | |
| 2012/0266449 | A1 * | 10/2012 | Krupa | F21S 8/043 29/592.1 |
| 2013/0016504 | A1 | 1/2013 | Garber | |

* cited by examiner

*Primary Examiner* — Jong-Suk (James) Lee
*Assistant Examiner* — Christopher E Dunay
(74) *Attorney, Agent, or Firm* — Bruce Young Arnold

(57) ABSTRACT

A combination is disclosed that includes: a shipping box containing a light fixture globe and base, the base having two mounting apertures, each having a slot contiguous thereto, with the width of the slots being smaller than the mounting apertures; a mounting bracket for mounting the base to a junction box; two screws for attaching the mounting bracket to the junction box; two mounting screws for mounting the base to the mounting bracket, with each mounting screw having a head larger than the width of the slot; and an elongated tool that is made of a flexible material, is hollow at one end, and can frictionally engage a mounting screw's head when the mounting screw is forced head-first into the hollow end to the point only its tip end protrudes from the elongated tool.

3 Claims, 3 Drawing Sheets

LIGHT FIXTURE AND TOOL FOR INSTALLING LIGHT FIXTURE

CROSS REFERENCE TO RELATED APPLICATION

This invention is related in subject matter to the "Method of Installing Light Fixture" as described in U.S. application Ser. No. 14/738,845 filed Jun. 13, 2015, the contents of which are hereby incorporated by reference.

BACKGROUND OF THE INVENTION

The present invention drastically reduces the amount of time needed to install a so-called "flushmount" light fixture to a junction box, as compared to the conventional installation instructions for flushmount light fixtures manufactured by HAMPTON BAY. The present invention should apply as well when installing flushmount light fixtures of similar design that are made by other manufacturers, such as COMMERCIAL ELECTRIC, PROGRESS LIGHTING, DESIGNERS FOUNTAIN, WESTINGHOUSE, and others. A flushmount light fixture is defined herein as a light fixture which, when mounted, a base portion of the light fixture contacts or is immediately adjacent to the surface to which the light fixture is mounted. Most often, these light fixtures are mounted so that a base portion of the light fixture contacts the ceiling.

Typically, installation hardware as well as installation instructions are supplied in the shipping box of the light fixture. Often the installation hardware includes a mounting bracket for attachment to a junction box, two pairs of machine screws, and electrical connectors. No tool for drastically decreasing the time required for installation of the light fixture is provided. The installation instructions describe a conventional method of installing a light fixture in which the installer is directed to screw, into threaded holes in the mounting bracket, mounting screws that later will be used to secure the base of the light fixture against or immediately adjacent the ceiling. These mounting screws are typically longer than the other pair of machine screws that are intended for use in attaching the mounting bracket to the junction box. It is not critical whether the mounting screws are installed into the mounting bracket before or after the mounting bracket is secured to the junction box. Once those two steps are completed, the mounting screws extend downward from the mounting bracket, with their heads lower-most. Next in the conventional method, a grounding wire of the light fixture base is attached to a grounding screw on the mounting bracket, and the light fixture base is temporarily supported by that grounding wire so as to allow the installer to use both hands when making electrical connections. After the electrical connections have been made (that connect wires in the junction box to wires in the light fixture), the next conventional step is to raise the light fixture until the heads of the mounting screws pass through mounting apertures in the base of the light fixture.

In addition to two mounting apertures in the light fixture base, each of these apertures has a slot contiguous thereto of a width smaller than that of the apertures. The width of the slots is slightly larger than the width of the shaft portion of the mounting screws, but smaller than that of the heads of the mounting screws, and the size of each mounting aperture is slightly larger than the heads of the mounting screws. After the heads of the mounting screws have passed through the mounting apertures as a result of the installer raising the base, conventional installation instructions direct that the base be moved (e.g., by rotation or sliding) so that the mounting screws engage the slots. The installation instructions then direct that the mounting screws be tightened.

There are several problems with the above-discussed, conventional method(s) of installing a light fixture that do not employ the elongated tool of the present invention.

A first problem is flushmount light fixtures usually have thermal insulation installed in the base of the light fixture. This insulation lies above the portion of the base having the mounting apertures and slots. Most often, the base is made of sheet metal, and the insulation serves to protect the ceiling from the heat of the light bulbs that are to be installed in the light fixture below the base. During installation of the base, when viewing is attempted from above the base, this insulation blocks the view of the installer from being able to see the mounting apertures - thus making it extremely difficult to (essentially blindly) align the mounting apertures with the downward-facing heads of the mounting screws. And, when the installer attempts to view from below the base, the insulation in the base makes it very difficult to see the downward facing heads of the mounting screws. Thus, the installer must use trail-and-error while blindly attempting to raise the base so that the heads of the downward facing mounting screws pass through the mounting apertures of the base. Moreover, when raising the base, the thermal insulation that is contacted by the heads of the mounting screws tends to be sheared-off. This material, which is irritating to the skin and eyes of an installer, often falls onto the face of an installer attempting to peer through one or more of these mounting apertures in the base (and the inch or more of insulation) so as to align the mounting aperture(s) with the head(s) of the mounting screw(s). If this insulation is removed from the base, the light fixture no longer complies with the electric code and the risk of fire is increased.

A second problem is raising the base as per the conventional installation method(s) may never achieve the desired result of passing the heads of both mounting screws simultaneously through their respective mounting apertures in the base. Due to manufacturing tolerances, it is often the case that the two mounting screws when threaded into the mounting bracket are not in parallel alignment. When this occurs, despite the number of times the base is raised, both mounting screw heads will not simultaneously align with the mounting apertures in the base until a lateral force has been applied to at least one of the two mounting screws installed in the mounting bracket. As mentioned above, because the installer is operating in an essentially blind manner, the direction in which a lateral force should be applied is unknown to the installer.

A third problem is the thermal insulation is often thicker than the base. Thus, when the base is raised to the point that a head of a mounting screw passes through a mounting aperture, the insulation in the base contacts the ceiling and exerts a small bias force in the downward direction on the base. This bias makes it difficult to maintain the head of a first mounting screw in the state of being passed through its mounting aperture while working to get the head of the second mounting screw passed through its mounting aperture. Thus, once the installer blindly succeeds in getting a first mounting screw head through a mounting aperture in the base, he must then blindly get the second mounting screw through a different mounting aperture in the base. While attempting this, the installer must continuously keep the base pressed upward against the ceiling. Otherwise, because the base is biased downward by the insulation as well as gravity, the first mounting screw easily passes back through its mounting aperture (i.e., upward relative to the base) and disappears from view. After this occurs once or twice, the installer is motivated to deviate from the installation instructions supplied with the light fixture and secure the first mounting screw into its respective mounting slot, and then to tighten the mounting screw somewhat so as to hold it in place. However, moving the base so that the shaft of the first mounting screw engages its respective slot generally misaligns the base from from having the second mounting screw be in alignment with the second mounting aperture of the base. In this situation, it becomes necessary to apply a lateral force to the second installation screw so as to achieve alignment of its head with that of the second mounting aperture in the base. However, because it is very difficult for the installer to simultaneously view both the mounting screw head and the mounting aperture in the base when raising the base (as discussed above), the direction this lateral force must be applied for alignment is very difficult for the installer to determine.

A fourth problem is the act of tightening a first mounting screw head against a slot in the base causes the material of the base, which often is either sheet metal or molded plastic, to deflect somewhat from being planar in the region near the head of the mounting screw. This deflection often results in a force component developing on the base that causes the base to move. More specifically, as the mounting screw is tightened against the slot, a force component often develops that causes the mounting screw to move along the slot in the direction of the contiguous mounting aperture. Thus, before tightening the head of the mounting screw against the slot, it is prudent for the installer to block the mounting aperture so as to prevent the mounting screw from re-entering that space and disappearing from view.

OBJECTS AND SUMMARY OF THE INVENTION

It is a first object of the invention to provide an elongated tool that enables the method of installing a light fixture as set forth in U.S. patent application Ser. No. 14/738,845, filed Jun. 13, 2015, to be performed so as to install a light fixture in a small fraction of the time otherwise required.

In the event a mounting bracket is supplied with a light fixture having multiple pairs of threaded holes (e.g., when the mounting bracket has been manufactured for shipping with two styles of light fixtures having different distances between the mounting apertures in the base), a second object of the invention is to prevent the mounting screw(s) from being inadvertently threaded into threaded holes of the mounting bracket not intended for use with the style of light fixture that was purchased. The elongated tool of the present invention, when used as set forth in the method of installing a light fixture described in U.S. patent application Ser. No. 14/738,845, and herein, makes it readily apparent to the installer which threaded holes in the mounting bracket are the appropriate ones to use when installing the base.

BRIEF DESCRIPTION OF THE DRAWINGS

FIG. 8 also illustrates the elongated tool when being used to install the base of a light fixture, which supports thermal insulation, to a mounting bracket at the point in time: after the mounting tool has been used to mount the mounting screw into a threaded hole in mounting bracket; after the base has been raised along the elongated tool to a point where a slot in the base is above the head of the mounting screw; and after the base has then been moved so that the elongated tool and shaft of the mounting screw enter the slot.

FIG. 10 shows the view as would be seen from above the base if both the thermal insulation 16 and the mounting bracket 7 (shown in FIG. 8) were invisible.

DETAILED DESSCRIPTION OF THE INVENTION

Figure 1:
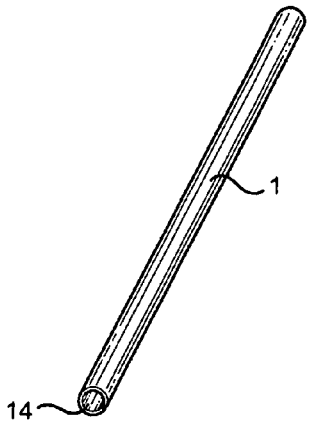
FIG. 1 illustrates an elongated tool that forms one element of the combination that comprises the present invention. In the preferred embodiment, the elongated tool is a conventional plastic drinking straw.
Figure 2:
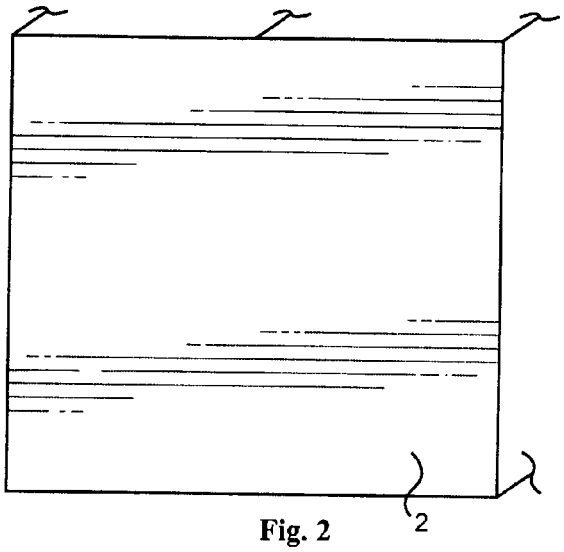
FIG. 2 illustrates another element of the combination, namely, a conventional shipping box.
Figure 3:
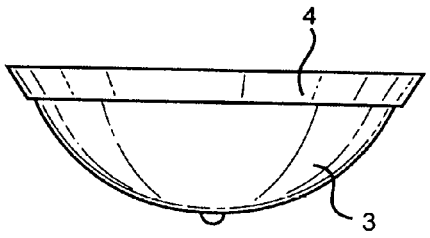
FIG. 3 illustrates two more elements of the combination, namely, a conventional light fixture base for mounting to a surface and a "globe" that is mounted below the base.
Figure 4:
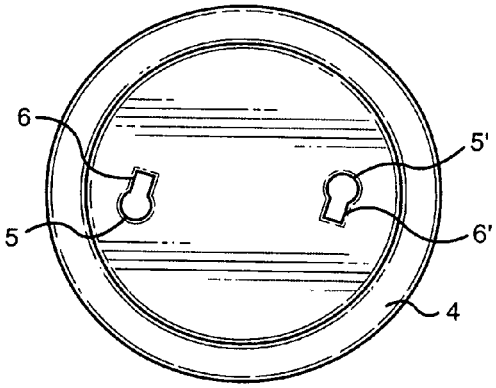
FIG. 4 illustrates two mounting apertures with slots contiguous thereto in the base.
Figure 5:
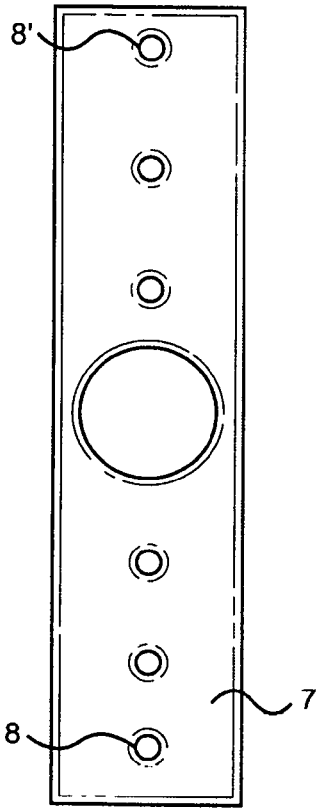
FIG. 5 illustrates another element of the combination, namely, a conventional mounting bracket used to mount a light fixture to a junction box.
Figure 6:
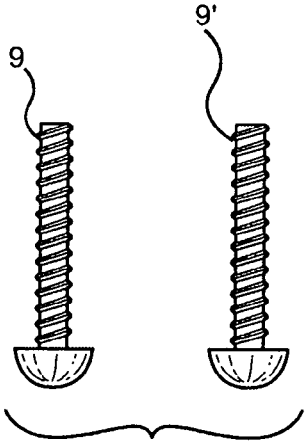
FIG. 6 illustrates another element of the combination, namely, a pair of conventional machine screws used to attach a conventional mounting bracket, such as the one illustrated in FIG. 5, to a junction box (not illustrated).
Figure 7:
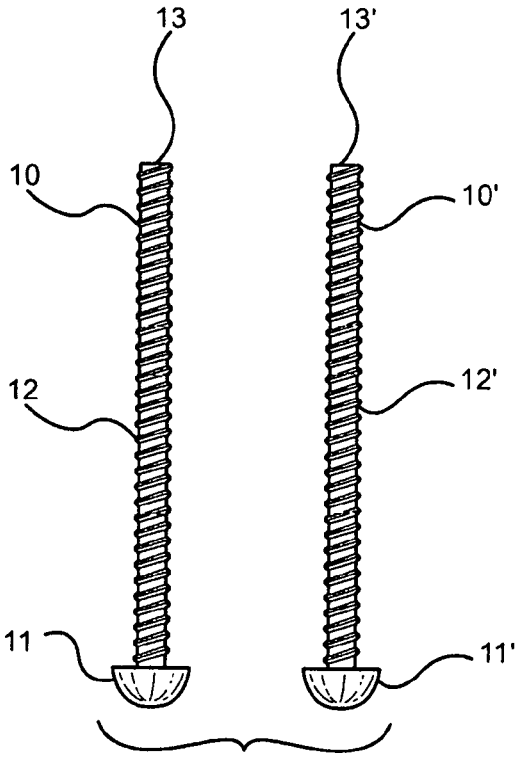
FIG. 7 illustrates another element of the combination, namely, a pair of conventional machine screws used to mount a conventional base portion of a light fixture (shown in FIG. 4) to a conventional mounting bracket (shown in FIG. 5).

According to a preferred embodiment of the present invention, an elongated tool 1 (FIG. 1) is provided in a shipping box 2 (FIG. 2) that includes a light fixture globe 3 and a base 4 (FIG. 3). The base 4 must be mounted to a surface (not shown) containing a junction box (not shown). As shown in FIG. 4, the base 4 includes two apertures 5, 5', each having a slot 6, 6' contiguous thereto. The shipping box 2 also contains a mounting bracket 7 (FIG. 5), having at least two pairs of holes therein, as well as a larger threaded hole (not labeled) at its center for mounting a metal nipple (not illustrated) that holds the globe 3 to the base 4 once the base has been mounted. One pair of holes in the mounting bracket is usually not threaded and is for attaching the mounting bracket to a junction box. (Sometimes, instead of unthreaded holes, slots are present for this purpose). Another pair of holes 8, 8' (possibly two pairs, one pair of which may remain unused) are threaded and are for attaching the base 4 to the mounting bracket 7. A pair of machine screws 9, 9' (FIG. 6) may be included to attach the mounting bracket 7 to a junction box (not shown), and another pair of machine screws 10, 10', herein termed "mounting screws" (FIG. 7) are included for mounting the base 4 to the mounting bracket 5. The elongated tool 1 is used for engaging a head 11 or 11' of a mounting screw 10 or 10' and keeping a shaft portion 12 or 12' of the mounting screw "in rough alignment" with a center axis (not labelled) of the elongated tool 1 when performing the method described in the related patent application. The term "in rough alignment" is herein defined as—sufficiently aligned that, when a tip end 13 or 13' of an engaged mounting screw is manipulated into an appropriate one of the threaded holes 8, 8' (see FIG. 5), of the mounting bracket and the elongated tool is then rotated, the threads of the engaged mounting screw will screw into that threaded hole—. A mounting screw (10 or 10'), after being forced head-first into a hollow portion 14 (FIG. 1) that is slightly smaller than the head of the mounting screw, will be "roughly aligned" with a central axis (not shown) of the elongated tool 1 by reason of all but about ⅛ inch of the screw tip end 13 FIG. 7) being inserted within a hollow portion 14 (FIG. 1) of the elongated tool 1.

Figure 8:
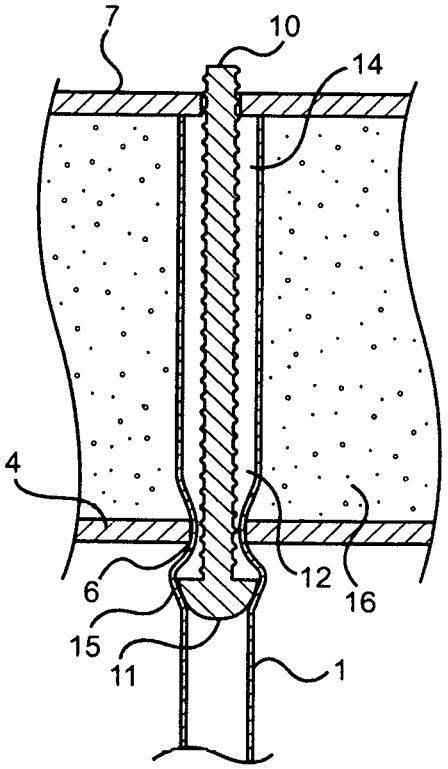
FIG. 8 is a vertical cross-sectional view of a hollow end portion of an elongated tool that frictionally engages a head of mounting screw in a region of the elongated tool where the head has caused the hollow end portion to expand due to the head being larger than the hollow end portion.

FIG. 8 is a vertical cross-sectional view (corresponding roughly to actual size) of a hollow end portion 14 of an elongated tool 1 that frictionally engages a head 11 of mounting screw 10 in a region 15 of the elongated tool where the head has caused the hollow end portion to expand due to the head being larger than the hollow end portion. FIG. 8 also illustrates the elongated tool when being used to install the base 4 of a light fixture, that supports a thermal insulation 16, to a mounting bracket 7 at the point in time: (a) after the mounting tool has been used to mount the mounting screw into a threaded hole in the mounting bracket 14; (b) after the base has been raised along the elongated tool to a point where a slot 6 in the base is above the head of the mounting screw; and (c) after the base has then been moved so that both the elongated tool 1 and the shaft 12 of the mounting screw have entered the slot 6.

Figure 9:
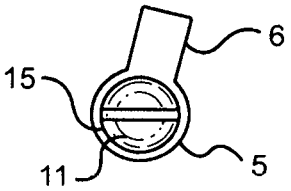
FIG. 9 is an enlarged view (corresponding roughly to actual size) of the mounting aperture and a contiguous slot in the base illustrated in the left part of FIG. 4. This figure shows an expanded portion of the elongated tool and the head of a frictionally engaged mounting screw as they pass through the mounting aperture in the base, as viewed from below the base.

FIG. 9 is an enlarged view (corresponding roughly to actual size) of the mounting aperture 5 and contiguous slot 6 illustrated in FIG. 4. This figure also shows, from a viewpoint directly below the mounting aperture, an expanded portion 15 of the elongated tool and the head 11 of a frictionally engaged mounting screw as they pass through the mounting aperture.

Figure 10:
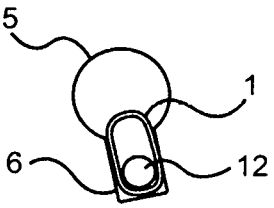
FIG. 10 shows the same mounting aperture and slot as illustrated in FIG. 9, but at a point in time: (a) after the mounting screw has been mounted to the mounting bracket; (b) after the base has been raised along the elongated tool until the head of the mounting screw has passed below the mounting aperture; and (c) after the base has then been moved so that the shaft of the mounting screw has entered the slot in the base that is contiguous to the mounting aperture. Because the head of the mounting screw would otherwise block one's view of the shaft of the mounting screw.

FIG. 10 shows, from a viewpoint directly above the slot (and to the same scale), the same mounting aperture 5 and slot 6 of FIG. 9 at a point in time: (a) after the mounting screw has been mounted to the mounting bracket; (b) after the base has been raised along the elongated tool until the head of the mounting screw has passed below the mounting aperture; and (c) after the base has been moved so that the shaft 12 of the mounting screw has entered the slot. The viewpoint is different in FIG. 10 as compared with that of FIG. 9 so that the head of the mounting screw does not block one's view of the manner in which the wall of the hollow end of the elongated tool 1 must flex and be thin in order for the shaft 12 of the mounting screw and the surrounding flexible material of the elongated tool to enter the slot 6.

The elongated tool 1 has an outer surface dimension that allows it and the frictionally engaged head 11 or 11' of the mounting screw (10 or 10') to pass upward through a mounting aperture 5 or 5' of the base 4, and it has a length that allows the installer (while holding the elongated tool from below the base), to manipulate the mounting screw's tip end (13 or 13') into an appropriate threaded hole 8 or 8' of the mounting bracket 7. This last-mentioned task is performed while viewing the base with the installer's eyes above the base. Thus, both the mounting screw's tip end (13 or 13') and the threaded hole(s) 8, 8' in the mounting bracket are visible to the installer. Prior to this, while viewing from below the base, the elongated tool and its nearly fully inserted mounting screw have been guided by the installer into a mounting aperture of the base and pushed upward through an aperture in the insulation (not shown).

The installer then changes his view, (e.g., by standing higher on a ladder) so that the mounting screw's tip end and the threaded hole(s) in the mounting bracket are visible and takes the following actions:

(a) using the elongated tool, the installer manipulates the first mounting screw into an appropriate threaded hole of the bracket, and then rotates the elongated tool until the first mounting screw is secured in that threaded hole;

(b) the base is then raised by sliding its aperture along the elongated tool, with the elongated tool serving as a guide, until the head of the first mounting screw engaged by the elongated tool passes through the mounting aperture in the base;

(c) the base is then moved so that the elongated tool and shaft of the first mounting screw enter the contiguous mounting slot in the base;

(d) the elongated tool is disengaged from the first mounting screw by pulling sharply downward on the elongated tool; and (e) the elongated tool may be inserted once more into the first mounting aperture, so as to block the first mounting screw from re-occupying that space.

The first mounting screw may be left not tightened, partially tightened, or fully tightened prior to the installer beginning work on mounting the base more securely than with a single mounting screw. If the first mounting screw has been fully tightened so as to make the base snug against a surface near one mounting aperture, the elongated tool can be removed from its blocking position and the above-mentioned process repeated for the second mounting screw and mounting aperture using the same elongated tool. However, fully tightening the first mounting screw is not recommended, as the base will be more difficult to move when aligning the base to accept the second mounting screw through a second mounting aperture.

If the first mounting screw has not been fully tightened, it is prudent to leave the elongated tool in its blocking position, and to use a second elongated tool, similar in shape and size to the first elongated tool, during the remainder of the installation process. Using two elongated tools as opposed to one is advantageous in that the task of getting the second mounting screw's tip end screwed into a hole in the mounting bracket can be performed with there being additional space between the ceiling and the base, since the first mounting screw has not been tightened or has been only partially tightened. Further, if a lateral force is needed in order to get the second mounting screw's head to align with the second mounting aperture in the base, as is usually the case—since the first mounting screw's shaft has been slid into the slot at the point, thereby misaligning the second aperture of the base, it will be easier to install the base to the mounting bracket as a result of that extra space.

Once the second mounting screw has been inserted into an appropriate threaded hole in the mounting bracket and then rotated by a second elongated tool so that the threads of its engaged mounting screw engage the threads of that threaded hole, the light fixture base up can be slid upward along that elongated tool. Just as before, when sliding the base upward, the elongated tool occupies the space of the mounting aperture in which it was first inserted, and thus guides the base so that the head of the mounted screw will pass through the mounting aperture once the base has been sufficiently raised.

Moreover, when using an elongated tool, in the event a lateral force is needed in order to get the second mounting screw's head through a mounting aperture when raising the base, it is readily apparent to the installer in what direction the lateral force should be applied. Namely, once the second mounting screw has been screwed into a threaded hole in the mounting bracket by rotating the elongated tool which engages it, the lateral force should be applied to the base in a direction so as to make the elongated tool with its engaged mounting screw be roughly perpendicular to the surface of the mounting bracket at the threaded hole being utilized by the second mounting screw.

The elongated tool is made of a sufficiently flexible material so that, when a mounting screw's head is frictionally engaged by the elongated mounting tool and the head is below the mounting aperture of the base, the base can be moved so that a shaft portion of the mounting screw with surrounding elongated tool slides into a slot contiguous to the mounting aperture.

Having described the combination invention, it will be readily apparent to those of ordinary skill in the art that the present invention is equally advantageous when mounting a light fixture base to a surface other than a ceiling. Thus, "upward" and "above" are defined herein more broadly than in a dictionary. "Upward" is defined as—a direction toward the mounting surface—and "above" is defined as—a position nearer the mounting surface—. Likewise, "downward" is defined as—a direction away from the mounting surface—and "below" is defined as—a position more remote from the mounting surface—. Further, it will be readily apparent that the outer surface of the elongated tool(s) of the present invention can be of various cross-sectional shapes (e.g., circular, triangular, square, pentagonal, hexagonal, heptagonal, octangular, etc.), the cross-section need not be the same over the entire length of the elongated tool(s), and it (they) can be made from various flexible materials, such a extruded plastic, moulded plastic, paper, and so on. In the preferred embodiment, the elongated tool is a plastic drinking straw made of polypropylene and the mounting apertures in the base are circular. However, it is not required that the mounting apertures in the base be of identical shape to that of the outer surface of the elongated tool(s).

What is claimed is:

1. A combination comprising:

a shipping box that includes the following items;

a light fixture base, said base having two mounting apertures, each mounting aperture having a slot contiguous thereto, with the width of each slot being smaller than its contiguous mounting aperture;

a mounting bracket;

two mounting screws for attaching the base to the mounting bracket, each mounting screw having a head larger than the width of the slots; and an elongated tool that is made of a flexible material, said elongated tool being hollow at one end;

a hollow end of the elongated tool has an inside dimension that is smaller than a head of at least one of said mounting screws but large enough to allow forceful insertion of that mounting screw's head into the hollow end so as to expand a portion of the flexible material of the elongated tool that contacts the head to thereby frictionally engage the head of that mounting screw;

the expanded portion of the elongated tool with frictionally engaged mounting screw has a dimension that is smaller than a mounting aperture in the base so as to enable the expanded portion that contacts the head of the mounting screw to be passed through a mounting aperture in the base; and the flexible material that forms the hollow end of the elongated tool has a wall thickness and flexibility that allows a shaft portion of the mounting screw and the hollow end of the elongated tool surrounding it to fit within a slot of the base.

2. The combination of claim 1, said elongated tool being a plastic drinking straw.

3. The combination of claim 2, the plastic of said plastic drinking straw being polypropylene.

* * * * *